United States Patent [19]

Dunn

[11] Patent Number: 4,483,020

[45] Date of Patent: Nov. 20, 1984

[54] PROJECTILE PROOF VEST

[75] Inventor: Anthony G. Dunn, Sturgis, Mich.

[73] Assignee: Jack P. Cittadine, Elkhart, Ind. ; a part interest

[21] Appl. No.: 442,304

[22] Filed: Nov. 17, 1982

[51] Int. Cl.[3] ..... F41H 1/02
[52] U.S. Cl. ..... 2/2.5
[58] Field of Search ..... 2/2.5

[56] References Cited

U.S. PATENT DOCUMENTS

| | | | |
|---|---|---|---|
| 3,395,067 | 7/1968 | Lane | 2/2.5 X |
| 3,634,889 | 1/1972 | Rolsten | 2/2.5 |
| 3,894,472 | 7/1975 | Davis | 2/2.5 X |
| 3,924,038 | 12/1975 | McArdle et al. | 2/2.5 X |
| 4,198,707 | 4/1980 | Haupt et al. | 2/2.5 |

*Primary Examiner*—Louis K. Rimrodt
*Attorney, Agent, or Firm*—James D. Hall

[57] ABSTRACT

A vest having projectile-stopping capabilities, including a network of inner shock-resistant plates lying under a layer of ballistic material to minimize the force imparted by a slowing projectile upon a wearer of the vest.

8 Claims, 7 Drawing Figures

PROJECTILE PROOF VEST

SUMMARY OF THE INVENTION

This invention relates to a vest having bullet or similar projectile-stopping capabilities.

Heretofore, vests with projectile-stopping capabilities have been constructed of material capable of stopping projectiles, such as bullets. Vests of this type are utilized mostly by police and riot control groups, as well as by the military. The problem with using prior art vests is that the sudden stoppage of the speeding projectile effects a massive transfer of kinetic energy to the vest and its user, causing a significant blunt trauma force to be transferred to the user.

In this invention, a combination of components serves to provide for a gradual slowing down and eventual stoppage of a projectile moving at high speed. The combination consists preferably of an outer deflector shield made of rigid material, such as polycarbonate, having raised pyramids protruding from its face, an inner layer of flexible ballistic material, and a set of impact-absorbing plates lying over the ballistic material. When a projectile is fired into a vest utilizing this combination, each unit plays a part in stopping the projectile and spreading out the kinetic energy force transferred while the bullet is slowing to a stop.

Accordingly, it is an object of this invention to provide for a vest which has the capability of stopping projectiles such as bullets without harming the user of the vest.

Another object of this invention is to provide for a vest which effectively distributes the blunt trauma force of a stopped projectile over a wide area, minimizing its effect on the vest user.

Another object of this invention is to provide a projectile-proof vest which is of lightweight construction and comfortable to wear.

Another object of this invention is to provide a projectile-proof vest which can be utilized for military and police work.

Still other objects of this invention will become apparent upon a reading of the following description.

BRIEF DESCRIPTION OF THE DRAWINGS

A preferred embodiment has been chosen to best illustrate the principles of the invention wherein.

DESCRIPTION OF THE PREFERRED EMBODIMENT

The preferred embodiment illustrated is not intended to be exhaustive or to limit the invention to the precise form disclosed. It is chosen to describe or to best explain the principles of the invention and its application and practical use to thereby enable others skilled in the art to best utilize the invention.

The vest 10 of this invention includes an inner covering layer 12 and an outer covering layer 14. Layers 12, 14 are preferably formed of flexible material, such as nylon. The shape of vest 10 may be contoured to fit most any body configuration, such as the chest configuration shown.

Figure 2:
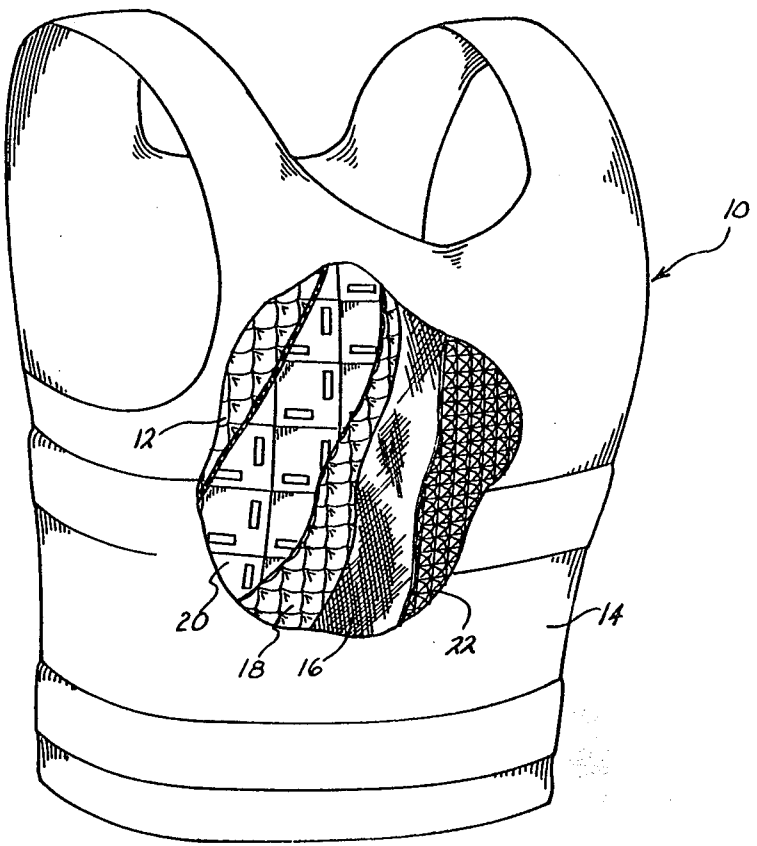
FIG. 2 is a front perspective view of the vest with selected components cut away for purposes of illustration.
Figure 1:
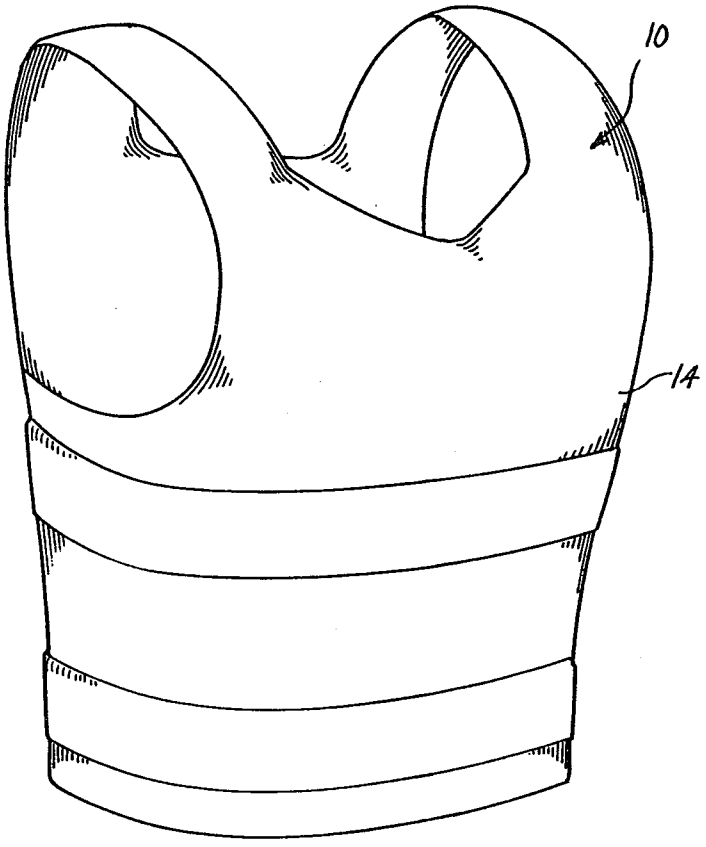
FIG. 1 is a front perspective view of the vest of this invention.
Figure 4:
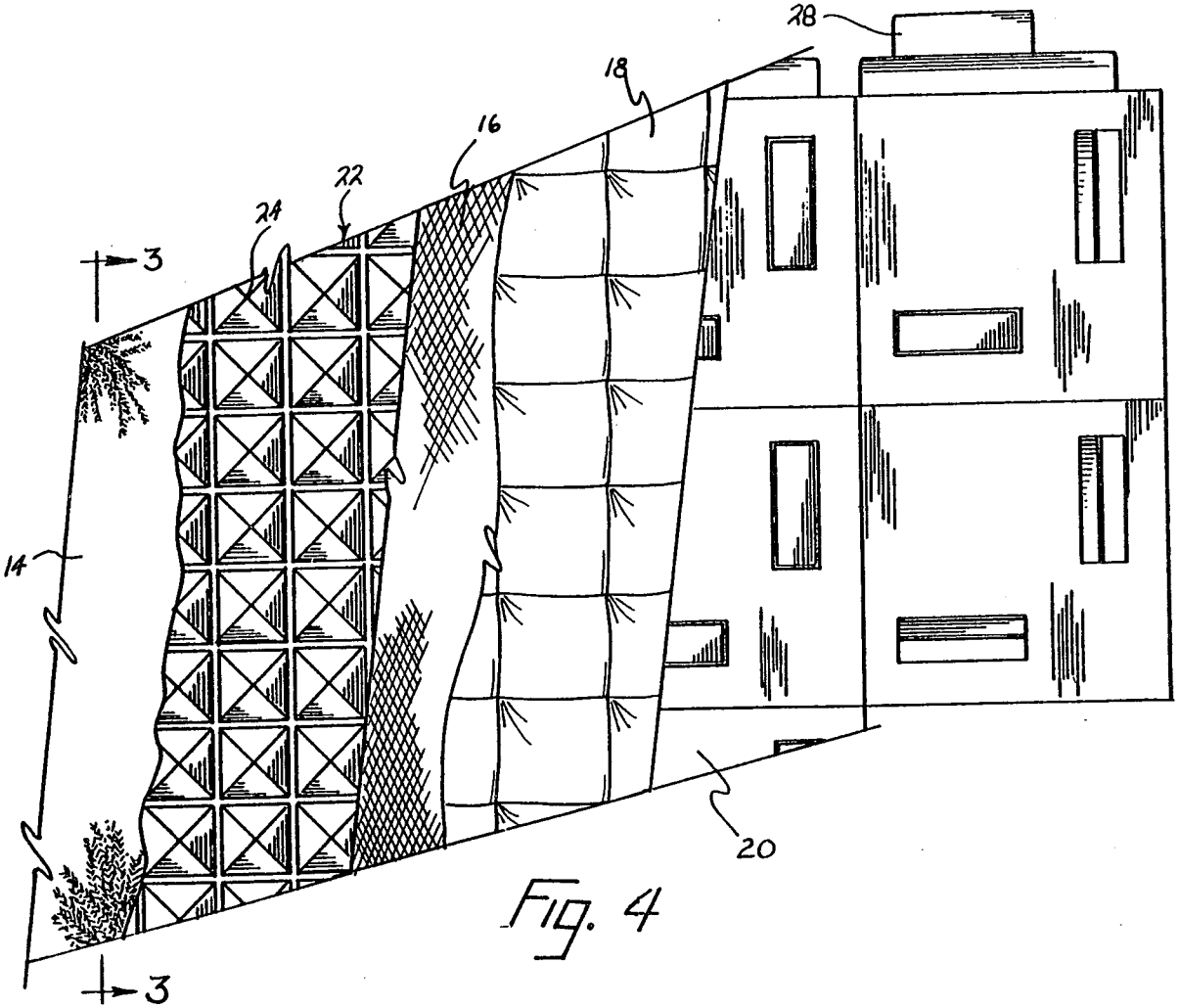
FIG. 4 is a fragmentary detailed front view of the vest components.
Figure 3:
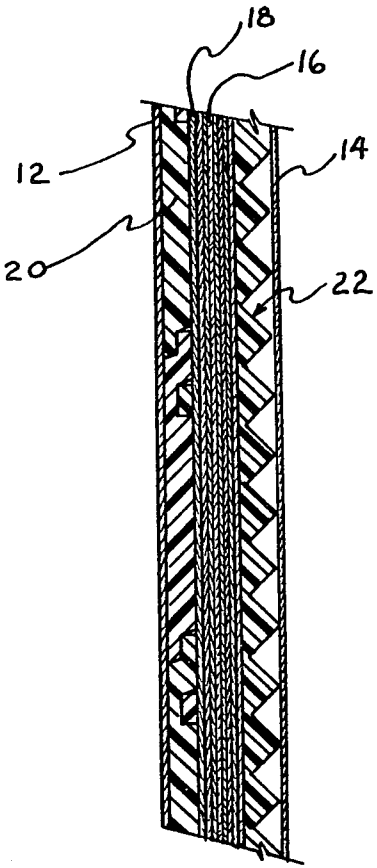
FIG. 3 is a fragmentary sectional view taken along line 3—3 of FIG. 4.
Figure 7:
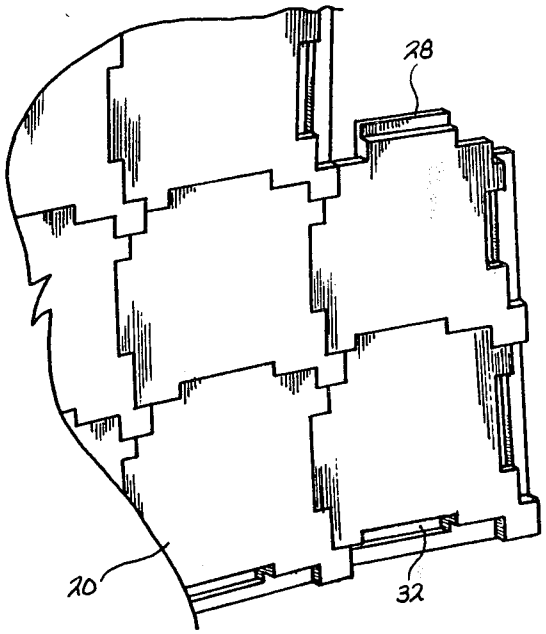
FIG. 7 is a rear view of the plate components of the vest, as seen from line 7—7 of FIG. 6.
Figure 6:
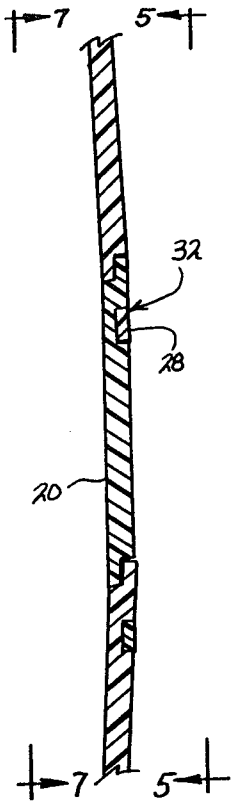
FIG. 6 is a fragmentary end view of the plate components of the vest.
Figure 5:
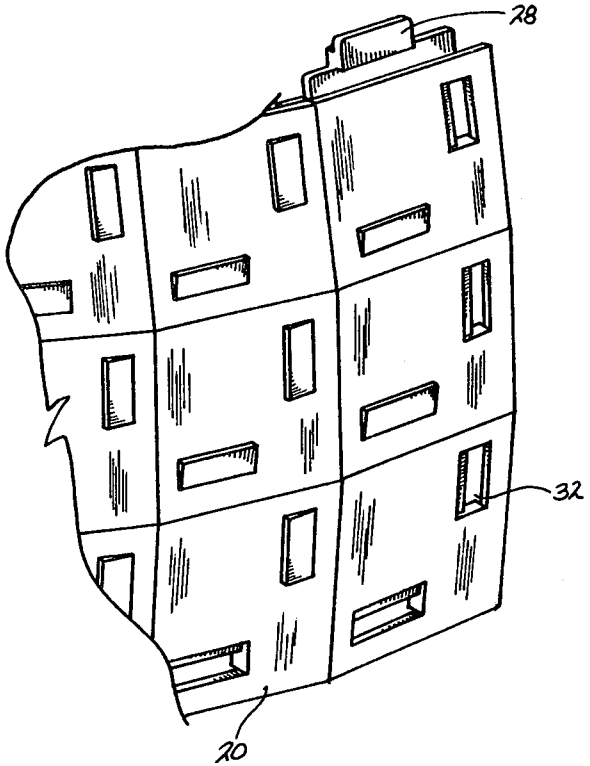
FIG. 5 is a front view of the plate components of the vest shown as flexed immediately following projectile impact, as seen from line 5—5 of FIG. 6.

Fitted between layers 12, 14 and next to layer 12 is a set of impact absorbing plates 20. Plates 20 are formed of flexible material, such as expanded polyethylene, and are constructed such that they may be sewn or interlocked together, forming a single impact-resistant unit. As shown in FIGS. 5–7, each plate 20 includes two outwardly projecting marginal tab parts 28 and two marginal recessed openings 32. Tabs 28 are constructed to be fitted into openings 32 of corresponding adjacent plates 20 to allow outward flexure of the plates in conforming to the user's body configuration and to interlock and resist inward flexing movement. The interlock of plates 20 in this manner allows the plates to form a rigid shock-absorbing network upon projectile contact. This network, through the non-flexing locking of plates 20, serves to distribute the force of a projectile coming into contact with vest 10 over a wide area.

Overlying plates 20 is an intermediate covering layer 18 which may be of a nylon material. A layer of ballistic material 16 and an overlying deflector shield 22 are located between covering layers 14 and 18, preferably fitted within pockets in the layers. Ballistic material 16 is flexible and is preferably of the interwoven fiber type in multiple overlying layers. Material 16 has the capability of resisting and slowing movement of a bullet or similar projectile, preferably without the bullet penetrating the material. Such materials are formed of aramid fibers with one such type of material being sold under the trademark "KEVLAR."

Deflector shield 22 is formed of a hard material, such as polycarbonate or ceramics, and includes numerous raised projections, shown as pyramids 24, which extend outwardly. When a projectile strikes shield 22 it is slowed and usually turned upon deflecting contact with a sloping side of a pyramid 24 before reaching ballistic material 16. In this manner the projectile strikes the ballistic material at an angle which reduces the penetration of the projectile.

If desired, the tops of pyramids 24 may be blunted and multiple shields 22 may be utilized. This structure would allow the areas between individual pyramids 24 to be offset between shields, thereby minimizing the chance of a projectile passing between pyramids and generally unobstructed through a single used shield 22. Shield 22 can be used optimally with plates 20. Where less projectile penetration capability is needed, or a lighter weight vest desired, shield 22 would not be used in conjunction with plates 20.

It is to be understood that this invention is not to be limited to the details above given, but may be modified within the scope of the appended claims.

I claim:

1. A vest having projectile-stopping capabilities comprising inner and outer material cover layers for positioning about a body part of the user, a layer of ballistic material fitted between said layers, said ballistic material being flexible and having projectile-entrapping capabilities upon projectile impact, and including a layer of shock-resistant plate means located adjacent said ballistic material and forming a generally rigid surface when struck by a projectile, said plate means for spreading out and distributing the blunt trauma force of said projectile over a wide area of said vest, the improvement wherein said plate means includes a plurality of juxtaposed plate parts fitted edge to edge, each plate part including an outwardly projecting tab and having a marginal recess opening, said tab of each plate part fitted restrictively into said marginal opening of an adjacent plate part and overlying a portion of said adjacent plate part so as to constitute means for providing a one directional non-flexing interlock with such adjacent plate part to define said rigid surface.

2. The vest of claim 1 wherein said plate means is located under said ballistic material.

3. The vest of claim 2 wherein said vest includes an outer deflector means positioned over said ballistic material said deflector means for turning said projectile so that the projectile contacts said ballistic material at an angle.

4. The vest of claim 3 wherein said shock resistant plate means is formed of expanded polyethylene and said deflector means is formed of polycarbonate.

5. The vest of claim 3 wherein said deflector means includes individual raised projections.

6. The vest of claim 5 wherein said raised projections have angled sides and are pyramidal in shape.

7. The vest of claim 1 wherein said ballistic material is formed of aramid fibers.

8. The vest of claim 1 wherein each plate part includes a second said tab and a second said marginal opening, said second tab of at least some of said plate parts fitted restrictively into said second marginal opening of at least some of the other adjacent plate parts and overlying a portion of such last mentioned other adjacent plate parts so as to also constitute said means for providing a one directional non-flexing interlock with said last mentioned other adjacent plate parts.

* * * * *